United States Patent [19]

Prevot et al.

[11] Patent Number: 4,902,056

[45] Date of Patent: Feb. 20, 1990

[54] LOCKING FITTING IN PARTICULAR FOR THE SLIDING LEAF

[75] Inventors: Gérard Prevot, Willerwald; Daniel Vigreux, Biberkirch, both of France

[73] Assignee: Ferco International, Sarrebourg, France

[21] Appl. No.: 95,648

[22] Filed: Sep. 14, 1987

[30] Foreign Application Priority Data

Sep. 16, 1986 [FR] France ..... 86 13044

[51] Int. Cl.[4] ..... E05C 1/06

[52] U.S. Cl. ..... 292/335

[58] Field of Search ..... 292/341–419, 292/DIG. 46, 335, 333, 334

[56] References Cited

U.S. PATENT DOCUMENTS 1,568,353 1/1926 Tullis ..... 292/335
2,293,363 8/1942 Schell ..... 292/335 X
4,480,862 11/1984 Fleming ..... 292/DIG. 46 X
4,607,510 8/1986 Shanaan et al. ..... 292/DIG. 46 X

*Primary Examiner*—Richard E. Moore
*Attorney, Agent, or Firm*—Sandler & Greenblum

[57] ABSTRACT

A locking fitting for the sliding leaf of a window, door, or similar type closure which includes, in its housing, a slide connected to a bolt with a hook. The hook cooperates with a keeper which is fixed against movement with the fixed frame. After the movable closure is opened, the hooked bolt is maintained in its unlocked position by a blocking device having an elastic return. Further, the blocking device is formed by an assembly separate from the slide and includes a support which is clamped in the U-section of the movable closure. The support is fitted with a blocking lever which cooperates with the keeper when the movable closure is closed so as to free the hooked bolt for movement and, in consequence, the slide.

15 Claims, 2 Drawing Sheets

LOCKING FITTING IN PARTICULAR FOR THE SLIDING LEAF

BACKGROUND OF THE INVENTION

1. Field of the Invention

The invention concerns a locking fitting, in particular for the sliding leaf of a window, door or similar type closure, comprising in its housing a slide connected to a bolt with a hook cooperating with a keeper in one piece with the frame and maintained in its opening position by a blocking device with elastic return.

2. Background and Relevant Information

A lock fitting is known, in particular for the sliding leaf of a window, door or similar type closure, comprising in its housing a slide connected to a bolt with a hook cooperating with a keeper in one piece with the frame and maintained in its opening position by a blocking device with elastic return. This blocking device comprises a guide situated above the fixing and adjusting screw of the hooked bolt and traversing from one side to another the bolt carrier in one piece with the slide. This guide, when displaced perpendicularly in the direction of displacement of the slide, serves as support for a probe.

In the open position, the guide-probe assembly is pushed outwards by an elastic element in such a way that the probe projects from the edge of the leaf and a boss of the guide cooperates with a striking plate obtained by a set-back made in one of the two parallel walls of the housing. When the leaf is closed again, the probe comes to rest against the keeper and displaces the guide towards the rear which disengages the cooperation between the boss of the guide and the striking plate of the set-back of the wall of the housing. This means that the slide can be brought to its locking position.

However, this fitting has several disadvantages. For instance, because the guide slides in a housing made in the bolt carrier of the leaf, either the bolt carrier is overdimensioned, particularly in respect of its thickness, and this causes an increase in the thickness of the housing and consequently of the leaf, or the blocking device with elastic return is relatively small, which makes this device less reliable. Moreover, the latter cannot be used except with a determined bolt carrier of special design.

SUMMARY OF THE INVENTION

This invention is aimed at overcoming these disadvantages. For this purpose, the invention concerns a locking fitting, in particular for the sliding leaf of a window, door or similar type closure, comprising in its housing a slide connected to a bolt with a hook cooperating with a keeper in one piece with the frame and maintained by a blocking device with elastic return, the latter consisting, finally, of an assembly separate from the slide and comprising means of positioning and of maintenance cooperating with the corresponding means of the sliding leaf. According to another characteristic of the invention, the blocking lever comprises a return arm cooperating with an elastic element housed in a recessed hole emerging into the vertical cut and a control arm cooperating with the keeper in one piece with the frame when the sliding leaf is closed. According to another characteristic of the invention, the control arm comprises a striking edge cooperating with the lower edge of the hook of the hooked bolt, in the open position of the sliding leaf.

The advantages obtained from this invention consist essentially in the fact that the blocking device is no longer dependent on the thickness of the bolt holder and therefore can be strengthened, reducing damage to it and increasing its reliability. Moreover, as it is a separate assembly, the blocking device can be installed on existing leaves already equipped with a locking fitting. Furthermore, the manufacture of the slide and the bolt holder is simplified, which also contributes to increasing their reliability while it permits their cost to be reduced. Finally, the blocking device arrives at a position under the keeper when the sliding leaf is closed, and it becomes impossible to lift the keeper. This means that the blocking device also plays a security role by thwarting any attempt to unhinge the sliding leaf.

BRIEF DESCRIPTION OF THE DRAWINGS

The invention will be clearly understood by referring to the following description which is given as a non-limitative example, and to the attached drawings in which.

Figure 1:
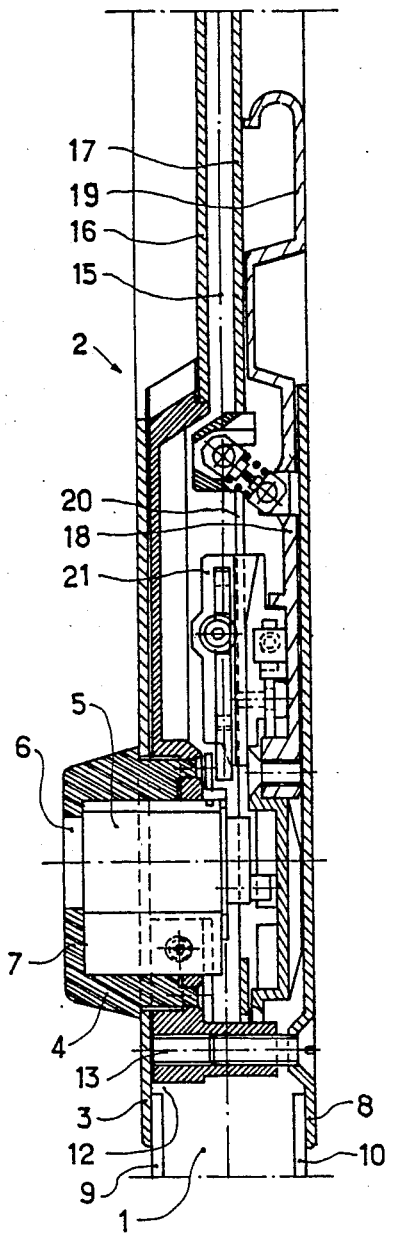
FIG. 1 is a view of the locking fitting of the invention according to section 1—1 of FIG. 2.

The sliding leaf 1 of a window, door or similar type closure comprises a locking fitting 2. This comprises an external plate 3 fitted with a boss 4 in which is housed a security block 5 which can be activated from the outside by a key passing through an orifice 6 made in a front surface of this boss 4. The locking fitting also comprises an internal plate 8. The internal 3 and external 8 plates, applied against the external faces 9, 10 of the sliding leaf 1 have at right angles to the locking fitting 2 a slot 12, and are held together by fixing elements 13.

The locking fitting 2 comprises a housing 15 consisting of two walls 16, 17 between which a slide 18 is displaced and can be activated by a grip 19 through a slot 20 cut out of the internal plate 8. The slide 18 is in one piece with a bolt holder 21 which serves as support for a bolt with a hook 22 which is placed perpendicularly in relation to the direction of displacement of the slide 18. This hooked bolt 22 has at least one hook pointing downwards. This hooked bolt 22, projecting from the wall 17 of the housing 15, is displaced between the two wings 24, 25 of a "U" section 26 which constitutes the edge of the sliding leaf 1. In the bottom 27 of this section 26, a slot 28 is cut out permitting the passage and vertical displacement of the hooked bolt 22. The hooked bolt 22 cooperates with a keeper 29 which is in one piece with the frame 30 and housed between the wings 31, 32 of a section 33 contituting the edge of the frame 30.

According to the invention, the locking fitting 2 comprises a blocking device 34. This is formed essentially of a support 35 provided with means of maintenance and position and with a blocking lever 36.

The support 35 is housed between the two wings 24, 25 of the section 26 and its breadth is slightly less than the space 38 between the internal faces 39, 40 of the two wings 24, 25. The rear face 41 of the support 35 applied against the bottom 27 of the section 26, comprises a boss 42 which also engages in the slot 28 cut in the bottom 27 of the section 26. The lower shouldering 43 of this boss 42 rests against the lower edge 44 of the slot 28. This lower edge 44 of the slot 28 constitutes one of the corresponding means of the sliding leaf 1 permitting the positioning of the blocking device 34. This lower shouldering 43 of this boss 42 and the lower edge 44 of the slot 28 constitute the means of positioning the blocking device 34. The height 45 of this boss 42 is slightly less than the thickness 46 of the bottom 27 of the section 26 to avoid the rear face 47 of the boss 42 hindering the displacement of the slide 18.

The rear face 41 is connected to the front face 48 by two inclined walls 49, 50. This front face 48, offset downwards from the rear face 41, rests against two vertical bosses 51, 52 projecting from the two internal faces 39, 40 of the two wings 24, 25 of the section 26 in the direction of the median plane 53. The front face 48 comprises a boss 54 in which a hole 55 is made. Engaged in this hole is a locking element 56 whose truncated point 57 rests against the bottom 27 of the section 26. Preferably, the locking element 56 is a screw, and consequently the hole 55 is a threaded hole. The rear face 41 has a clearance 58 so that the locking element 56 can project. Thus the means of locking the blocking device 34 are constituted by the screw 56. Activation of this screw tends to confer on the support a certain rotation in relation to the lower shouldering 43 of the boss 42, in such a way that the rear face 41 of the support 35 is flattened against the bottom 27 of the section 26 whereas the front face 48 is flattened against the vertical bosses 51, 52 of the two wings 24, 25 of the section 26 so that in this way we obtain two opposite locking zones. Thus the bottom 27 of the section 26 and the two vertical bosses 51, 52 of the two wings 24, 25 of the section 26 constitute other corresponding means of the sliding leaf 1 permitting the blocking device 34 to be maintained in its position. In the body 59 of the support 35, a vertical cut 60 is made in which the blocking lever 36 is placed. This lever can pivot around an axis 61 whose extremities 62, 63 engage in the orifices 64, 65 made in the faces 66, 67 of the body 59.

The blocking lever 36 has at its lower extremity 68 a return arm 69 pivoting in the vertical cut 60. The lower extremity 70 of this return arm 69 has on its outside face 71 a stud 72 on which is threaded the extremity 73 of an elastic element 74 whose other extremity 75 is lodged in a recessed hole 76 made in the body 59 of the support 35 and emerging perpendicularly into the vertical cut 60. This elastic element 74 is in a prestressed position between the bottom 77 of the recessed hole 76 and the outer face 71 of the return arm 69.

In addition, the blocking lever 36 has at its upper extremity 78 a control arm 79 situated practically in the prolongation of the return arm 69. This control arm 79 has at its upper extremity 80 a striking edge 81 against which rests the lower edge 82 of the hook 23 of the hooked bolt 22. In addition, the control arm 79 has a camber situated between the striking edge 81 and the upper extremity 78 of the blocking lever 36. This camber 83 permits the striking edge 81 to be retracted between the two wings 24, 25 of the section 26 of the sliding leaf 1.

Furthermore, the body 59 of the support 35 narrows towards its vertical edge 84 to facilitate its penetration between the two wings 31, 32 of the section 33 of the frame 30 when the fitting is in the locked position.

Figure 2:
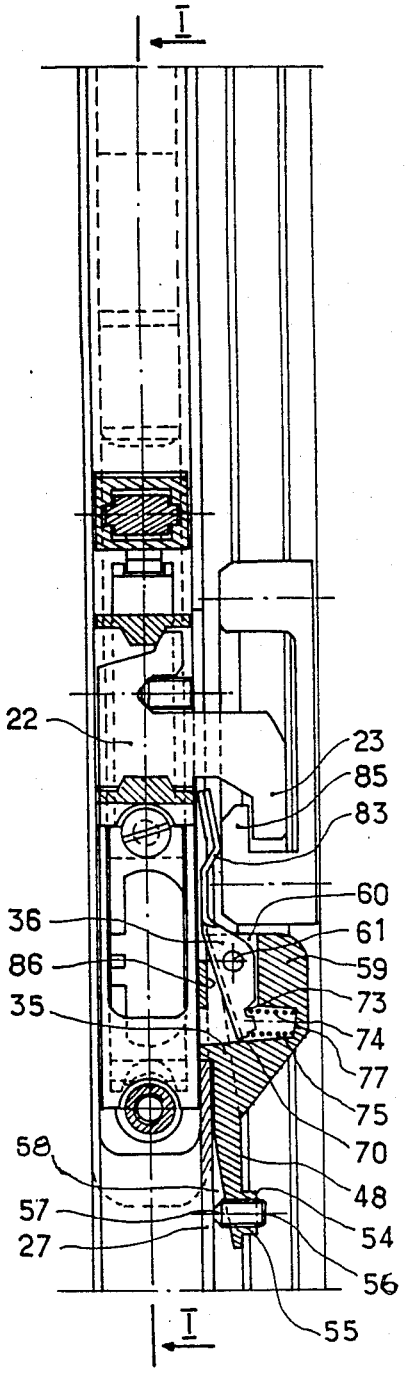
FIG. 2 is a view in elevation and in section of the locking fitting in the locking position.
Figure 3:
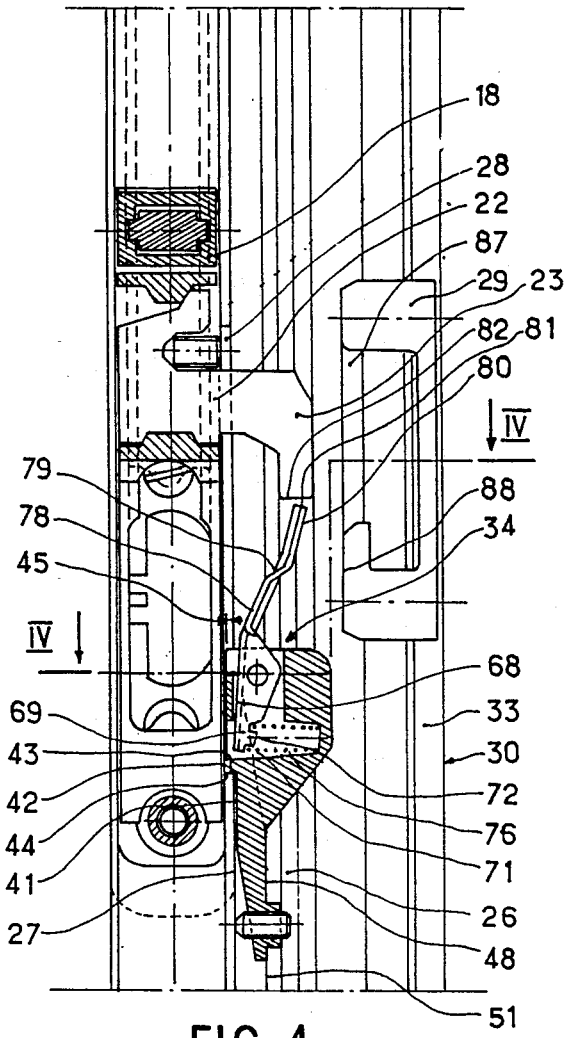
FIG. 3 is a view in elevation and in section of the locking fitting when the leaf is in the open position.
Figure 4:
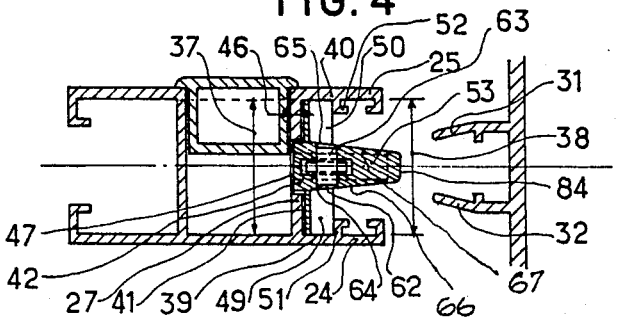
FIG. 4 is a plane view and a section according to section IV—IV of FIGS. 3.

The invention works as follows:

Consider the leaf in the locked position as shown in FIGS. 1 and 2. Using the grip 19, one lifts the slide 18 and, in consequence, the hooked bolt 22. This makes the hook 23 disengage from the active part 85 of the keeper 29. Then we open the sliding leaf 1 of the window, door or similar type closure. During the sliding of the leaf, the elastic element 74 slackens and acts on the return arm 69 by causing the rotation of the blocking lever 36 so that the control arm 79 describes an arc in a clockwise direction limited by the contact between the return arm 69 and the rear wall 86 of the vertical cut 60. During this rotation, the striking edge 81 is moved under the lower edge 82 of the hook 23 of the hooked bolt 22. This makes it impossible to lower the slide 18, and the hooked bolt 22 is maintained opposite the opening 87 of the keeper 29 as shown in FIG. 3.

By closing the sliding leaf 1, the front face 88 of the keeper 29 rests on the upper extremity 80 of the control arm 79, causing the blocking lever 36 to rotate in the opposite direction from its previous rotation, until the camber 83 of the control arm 79 is in contact with this front face 88 of the keeper 29. Simultaneously, the return arm 69 describes an arc and compresses the elastic element 74. The striking edge 81 being situated in the clearance 89 of the hooked bolt 22 and the hook 23 being inside the keeper 29, it becomes possible to activate the sliding 18 so as to bring it into the locking position as seen in FIG. 2. Thus the blocking device 34 moves under the keeper 29 and it becomes impossible to lift the sliding leaf 1 after closing and locking.

We claim:

1. A locking fitting for a closure, said closure being movable between an open position and a closed position relative to a fixed frame, said closure comprising means mounted thereon for latching said closure to said fixed frame, said means for latching being mounted with respect to said closure between a locked position and an unlocked position, said locking fitting comprising:

(a) means for blocking movement of said means for latching to its locked position, said means for blocking being adapted for mounting on said closure in spaced cooperation with said means for latching on said closure;

(b) means for positioning said means for blocking on said closure in spaced cooperation with said means for latching on said closure; and (c) means for maintaining said means for blocking on said closure in spaced cooperation with said means for latching on said closure.

2. The locking fitting of claim 1 wherein said means for blocking further comprise means for blocking movement of said closure when said means for latching are in said locked position.

3. The locking fitting of claim 2 wherein said closure includes an end comprising an open U-section at one edge, said U-section having a base and two wings, wherein said closure movement blocking means comprise a support adapted for mounting within said U-section.

4. The locking fitting of claim 3 wherein said latching means blocking means comprises a lever mounted for movement around an axis located in said support.

5. The locking fitting of claim 3 wherein said support comprises a rear face having a boss projecting therefrom, said boss being adapted to extend within a slot located in said base of said U-section, said slot being adapted to permit the passage of a hooked bolt of said means for latching.

6. The locking fitting of claim 5 wherein said base of said U-section has a predetermined thickness, and wherein said boss has a height less than said predetermined distance.

7. The locking fitting of claim 6 wherein said means for positioning said means for blocking comprises a lower surface of said boss which is formed to engage a lower edge of said slot located in said base.

8. The locking fitting of claim 3 wherein said support has a width less than the distance between said two wings of said U-section, wherein said support comprises a rear face for engagement against said base of said U-section, a front face extending downwardly beyond said rear face for engagement against a vertically extending boss projecting from an inside surface of each respective wing of said U-section, and two inclined surfaces connecting said front face and said rear face on either side of a body portion of said support.

9. The locking fitting of claim 8 further comprising a further boss extending from said front face having a locking element for said means for blocking engaged within a hole in said further boss, said locking element having a truncated point for engagement with said base of said U-section, wherein said means for maintaining said means for blocking comprises said locking element, the position of said front face extending downwardly beyond said rear face.

10. The locking fitting of claim 9 wherein said rear face includes a portion to be spaced from said base of said U-section through which said truncated point of said locking element projects.

11. The locking fitting of claim 4, wherein said support includes a slot within which said lever is pivotable around said axis.

12. The locking fitting of claim 11 wherein said lever comprises a return arm, wherein said support further comprises a hole communicating with said slot within which an elastic element is located for biasing against said return arm, a control arm extending from said return arm and positioned for engagement with a keeper attached to said fixed frame.

13. The locking fitting of claim 12 wherein said control arm comprises a striking edge for engagement with a portion of said means for latching for blocking movement of said means for latching to its said locked position when said closure is in its said open position.

14. The locking fitting of claim 13 further comprising a camber portion and said control arm of said lever for retracting said striking edge, between said two wings of said U-section, from engagement with said means for latching when said closure is in its said closed position.

15. The locking fitting of claim 8 wherein said body portion extends and is narrowed from said base of said U-section to facilitate insertion of said body portion between a pair of wings of a section of said fixed frame.

* * * * *